US007175460B2

(12) United States Patent
Tschope et al.

(10) Patent No.: US 7,175,460 B2
(45) Date of Patent: Feb. 13, 2007

(54) SHEATHED CABLE FOR UNDERGROUND MINING

(75) Inventors: Jurgen Tschope, Selm (DE); Sebastian M Mundry, Ludinghausen (DE); Reiner Frank, Gevelsberg (DE)

(73) Assignee: DBT GmbH, Lunen (DE)

( * ) Notice: Subject to any disclaimer, the term of this patent is extended or adjusted under 35 U.S.C. 154(b) by 0 days.

(21) Appl. No.: 11/296,824

(22) Filed: Dec. 7, 2005

(65) Prior Publication Data

US 2006/0121777 A1 Jun. 8, 2006

(30) Foreign Application Priority Data

Dec. 8, 2004 (DE) ..... 20 2004 019 051 U

(51) Int. Cl.
*H01R 13/52* (2006.01)

(52) U.S. Cl. ..... 439/276; 439/436; 439/460

(58) Field of Classification Search ..... 439/276, 439/936, 460, 610
See application file for complete search history.

(56) References Cited

U.S. PATENT DOCUMENTS 3,816,641 A * 6/1974 Iversen ..... 174/76
3,945,700 A * 3/1976 Didier ..... 439/589
4,874,335 A * 10/1989 Kussel et al. ..... 439/589
4,963,104 A * 10/1990 Dickie ..... 439/460
5,387,129 A * 2/1995 Hotea ..... 439/587
5,447,453 A * 9/1995 Smith et al. ..... 439/701
6,078,712 A * 6/2000 Tschope et al. ..... 385/101
6,112,597 A * 9/2000 Tschope ..... 73/756
6,113,429 A * 9/2000 Weigel et al. ..... 439/610
6,142,805 A * 11/2000 Gray et al. ..... 439/206
6,162,085 A * 12/2000 Chugh et al. ..... 439/467
6,607,403 B2 * 8/2003 Tschope et al. ..... 439/610
6,851,962 B2 * 2/2005 McCormack, III ..... 439/276
6,957,970 B2 * 10/2005 Weigel et al. ..... 439/320
2005/0118871 A1 * 6/2005 Zemba ..... 439/610

* cited by examiner

*Primary Examiner*—Ross N. Gushi
(74) *Attorney, Agent, or Firm*—Cook, Alex, McFarron, Manzo, Cummings & Mehler, Ltd.

(57) ABSTRACT

A sheathed cable for underground mining, comprising a flexible sheath (2) containing armouring (3) and receiving the electric conductors (4), a cable connector (30) being mounted on one end of the sheathed cable and comprising a one-part hollow coupling sleeve (31) which engages over the sheath (2) and receives the end of the sheathed cable in tension-resistant manner in a compression joint and also comprises a plug insert (32) connected to the sleeve (31) by a snap-in connection and receiving contact elements preferably in the form of pins (36) and sockets (37) electrically connected to the conductors (4), wherein a cable feed-through opening (39) in the hollow coupling sleeve (31) is partly filled with sealing compound (38), wherein the coupling sleeve (31) has a continuation (34) which is deformable in order to make the compression joint and exclusively receives the sheathed cable (1), sheath (2), conductors (4) and armouring (3).

12 Claims, 1 Drawing Sheet

SHEATHED CABLE FOR UNDERGROUND MINING

Figure 1:
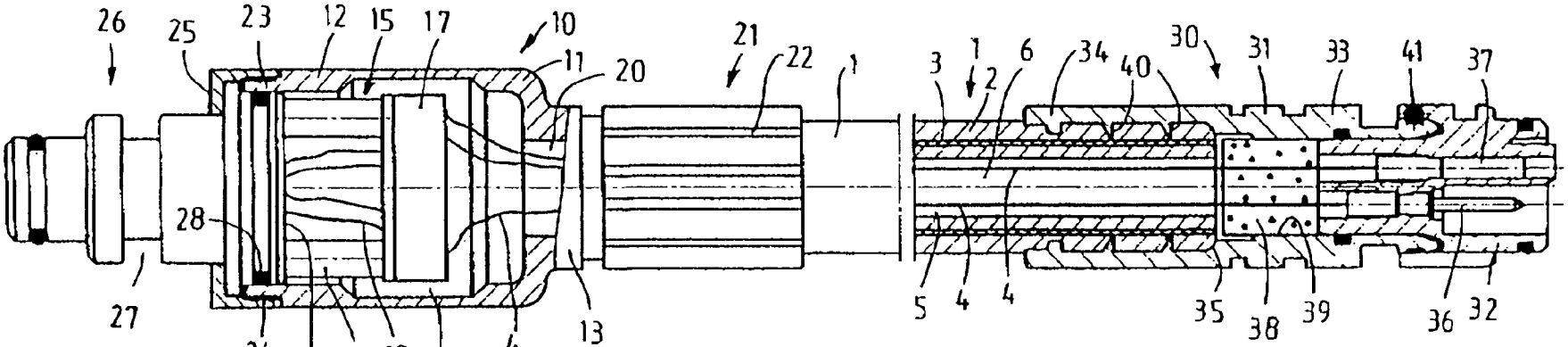

The present invention relates to a sheathed cable for underground mining, comprising a flexible sheath containing armouring and receiving the electric conductors, a cable connector being mounted on one end of the sheathed cable and comprising a one-part hollow coupling sleeve which engages over the sheath and receives the end of the sheathed cable in tension-resistant manner in a compression joint and also comprises a plug insert connected to the sleeve by a snap-in connection and receiving contact elements preferably in the form of pins and sockets electrically connected to the conductors, wherein preferably a cable feed-through opening in the hollow coupling sleeve is partly filled with sealing compound.

A sheathed cable in accordance with the preamble and with a connected cable connector is proposed in DE 197 45 482 C2. In the cable in accordance with the preamble, a supporting sleeve (bush) is disposed between the cable armouring and the inner conductors, and is compressed and tightened against the compression portion of the coupling sleeve in order to obtain a tension-resistant compression joint. The process for assembling this supporting sleeve is complicated and requires additional steps, thus increasing the cost of producing a said sheathed cable with connected coupling connector.

It is an aim of the invention is to construct a sheathed cable and cable connector which can be easily assembled and economically produced.

Accordingly the present invention is directed to a sheathed cable for underground mining as described in the opening paragraph of the present specification, wherein the coupling sleeve has a continuation which is deformable in order to make the compression joint and exclusively receives the sheathed cable, sheath, conductors and armouring. The sheathed cable in accordance with the invention, therefore, does without an additional protective sleeve and the compressive forces of the coupling sleeve are received via the structure of the sheathed cable, especially the armouring. A cable connector of this construction can therefore be fitted more quickly and easily than in the prior art.

Advantageously the sealing compound is cast directly on the back of the contact elements facing the cable.

Preferably also, the coupling sleeve and the extension integrally formed thereon are formed of brass and are connected in tension-resistant manner to the sheathed cable exclusively via a crimp connection.

Especially advantageously, a sensor is firmly fastened on the other end of the cable and comprises a sensor device disposed in a casing and scanning measurements or variables and converting them into electric signals, wherein a connecting element in the form of a plug or socket is fastened to the sensor casing and can be coupled to a receiving connection on an underground device, and wherein the sensor casing comprises a portion with a cable insertion opening at which the sensor end of the sheathed cable is fastened in tension-resistant manner and through which the conductors of the cable are firmly connected to the sensor device.

A sheathed sensor cable of this construction, already equipped with coupler plugs, is relatively short at both connected ends, thus reducing the space required for fitting the cable and sensor on an underground device such as an extraction plant or a shaft-lining support.

Preferably advantageously, the armouring is bonded in the cable sheath, and/or a cable surrounding the conductors with plastics material insulation is disposed inside the sheath.

Advantageously, the sensor device can be multi-part and comprise a measuring body spaced apart from an electric measuring unit and connected thereto by electric connecting cores, wherein the conductors in the sheathed cable are firmly connected to the electronic measuring unit.

Preferably the sheathed cable is connected in tension-resistant manner to the sensor by a one-piece crimpable insertion sleeve formed integrally on the sensor casing and engaging over the sensor end of the sheathed cable.

Alternatively the sheathed cable can be secured in tension-resistant manner to the sensor casing by a separate crimp barrel, to which end the sensor casing, at or near the cable insertion opening, can have a collar with a web which engages under the crimp barrel.

Preferably the connecting element can be fastened to the sensor casing by a screwable fixing ring. Advantageously, the sensor device comprises a pressure sensor and the receiving connection on the underground device is a hydraulic connection.

Preferably the sensor can be a temperature sensor or the like.

An example embodiment of a sheathed cable made in accordance with the present invention will now be explained with reference to the accompanying drawing.

FIG. 1 shows a sheathed cable with a sensor at one end and a coupler plug at the other end, with the sensor casing and the plug being shown only partially.

FIG. 1 shows a sheathed cable 1 of the construction conventionally used in underground mining which comprises an outer protective means or sheath 2 and preferably incorporates armouring 3, wherein a number of electric conductors 4 extend in the hollow core of the sheath 2 inside the armouring 3 and are preferably themselves surrounded by insulation or bonded in a cable 6 with insulation 5. The basic structure of a sheathed cable of this structure for use in underground mining is known, and therefore no further explanations will be given here.

The sheathed cable 1 shown in part in FIG. 1 comprises an electric coupler plug 30, for coupling for example to an individual electronic control unit, at its right end and a sensor 10 firmly and non-releasably connected to the left end of the cable 1, the overall result being a sheathed sensor cable which is immediately ready for use and connectable between the underground device and an evaluating means.

The structure of the sensor 10 connected directly to the cable 1, that is without a detachable plug-in connection, will now be described.

The sensor 10 has a hollow brass casing 11 comprising a front hollow portion 12 with a larger outer diameter and a smaller-diameter rear integrally-moulded portion 13. A sensor device 15 is disposed and protected in the interior 14 of the front portion 12, and in the embodiment shown is a pressure pick-up or pressure sensor. The sensor device 15 here is multi-part and comprises a measuring body 16 such as a DMS strain gauge and a diagrammatically indicated electronic measuring unit 17, which can for example be disposed on a circuit board and comprise an amplifier circuit and an auxiliary electronic unit. The electronic measuring unit 17 is separated from the measuring body 16 by a spacer sleeve 18 and electrically connected thereto by a number of electric conductors 19, so that the measurement signals received by the measuring body 16 and converted into electric signals can be supplied by the electronic unit 17 via the cable 1 to an evaluating device (not shown) such as an electronic control unit for shield-type shaft-lining supports. To this end the rear portion 13 of the sensor casing 11 has a cable insertion opening 20 through which the conductors 4 of the cable 1 are firmly and non-releasably connected to the electronic unit 17 of the sensor device 15. The rear portion 13 and cable insertion opening 20 also constitute a fastening means for tension-resistant securing of the cable 1 to the sensor casing 11 or sensor 10. In the example embodiment shown, a brass insertion or crimp bush 21 surrounding the cable insertion opening 20 is integrally formed on the rear portion 10 of the sensor casing 11 and, as shown by longitudinal grooves 22, can be crimped and compressed for the purpose of tension-resistant securing of the sheathed cable 1 inserted into the crimp bush 21.

The front end of the front portion 12 of the sensor casing 11 has an axial extension 23 which on its outer periphery has an outer screw thread 24 for screwing on a fixing ring 25 in the form of a screw cap. A connecting element 26 or socket in this case is fastened to the fixing ring 25 on the sensor casing 11 and is insertable into a receiving connection on an underground device (not shown) in conventional manner in underground mining, via a U-shaped plug-in fork which engages in a peripheral annular groove 27 on the connecting element 26 and is fastened there. In the case of a pressure sensor the connecting element 26 is formed with a bore (not shown) through which the measuring body 16, which when assembled is disposed on the back of the connecting element 26, is in contact with the hydraulic medium and consequently with the measured variable or variable of state. An additional seal in the form of an O-ring 28 is inserted into a peripheral groove on the connecting element 26 and when assembled bears on the inner periphery of the front portion 12 of the sensor casing 11.

The right-hand half of FIG. 1 shows a coupler plug 30 fastened in tension-resistant manner to the other end of the cable and comprising a brass coupling sleeve 31 connected by a catch connection to a plug insert 32. The catch connection is secured by one or more peripherally distributed metal balls 41 or plastics material elements, disposed on the overlapping regions of the plug insert 32 and the coupling sleeve 31. The hollow coupling sleeve 31 has an end coupling portion 33 which receives the plug insert 32 and an integrally connected sleeve continuation 34 into which the end of the cable, the sheath 1, armouring 3, insulated cable 6 and conductors 4 are inserted, in a manner such that only the conductors 4, with their insulated covering if required, project over an inner shoulder 35 at the foot of the extension 34 and at the transition to the coupling portion 33. The conductors 4 are firmly connected to contact pins 36 or complementary contact sockets 37 in the form of complementary contact elements in the plug insert 32, in order to make an electric connection with identically shaped contact elements in plug-in sockets on an electronic control unit or the like. A filler member 38 formed of sealing compound is formed between the back of the contact elements and the cable end adjoining the shoulder 35 and receives tensile forces and fixes the contacts and prevents moisture travelling through the hollow cable passage opening 39 inside the sleeve 31 of the coupler plug 30. After the conductors 4 have been fitted on the contact elements 36, 37 and the sealing compound 38 has been introduced, the extension 34 is compressed for example by a suitable crimping tool so that projections 40 on the inner periphery of the extension 34 press into the sheath 2 of the cable 1 and secure the cable 1 in tension-resistant manner to the sleeve 31 and consequently to the coupler plug 30. As clearly shown in FIG. 1, the entire tension-resistant connection is formed exclusively via the structure of the protective sheath 1 and by compressing or crimping the extension 34 without interposition of any additional parts such as supporting sleeves or the like between the cable 6 and armouring 3 or sheath 2.

For a person skilled in the art, the above-mentioned description gives rise to a series of modification which fall within the scope of the attached claims. For example, the tension-resistant connection between the sheathed cable and the sensor casing can also be formed via a separate crimp sleeve, which is slid on to a portion of the sensor casing so that an inner ring thereon engages under an annular collar on the casing portion in the neighbourhood of the cable insertion opening, if the crimp sleeve is compressed and engages in the protective sleeve of the cable.

The invention claimed is:

1. A sheathed cable for underground mining, comprising a flexible sheath containing armouring and receiving the electric conductors, a cable connector being mounted on one end of the sheathed cable and comprising a one-part hollow coupling sleeve which engages over the sheath and receives the end of the sheathed cable in tension-resistant manner in a compression joint and also comprises a plug insert connected to the sleeve by a snap-in connection and receiving contact elements electrically connected to the conductors, wherein a cable feed-through opening in the hollow coupling sleeve is partly filled with sealing compound, in which the coupling sleeve has a continuation which is deformable in order to make the compression joint and exclusively receives the sheathed cable, sheath, conductors and armouring and in which the coupling sleeve and continuation are connected in tension-resistant manner to the sheathed cable exclusively via a crimp connection.

2. A sheathed cable according to claim 1, in which the sealing compound is cast between the back of the contact elements and an end of the cable.

3. A sheathed cable according to claim 1, in which the receiving contact elements are in the form of pins and sockets.

4. A sheathed cable according to claim 1, in which the armouring is bonded in the cable sheath or a cable with insulation surrounding the conductors is disposed inside the sheath.

5. A sheathed cable according to claim 1, in which the coupling sleeve and continuation integrally formed thereon are of brass.

6. A sheathed cable according to claim 1, in which a sensor is firmly fastened to the other end of the cable and comprises a sensor device disposed in a casing and scanning measurements or variables and converting them into electric signals, wherein a connecting element in the form of a plug or socket is fastened to the sensor casing and can be coupled to a receiving connection on an underground device, and wherein the sensor casing has a portion with a cable insertion opening at which the sensor end of the sheathed cable is fastened in tension- resistant manner and through which the conductors of the cable are firmly connected to the sensor device.

7. A sheathed cable according to claim 6, in which the sensor device is multi-part and comprises a measuring body spaced apart from an electronic measuring unit and connected thereto by electric connecting cores, wherein the conductors are firmly connected to the electronic measuring unit.

8. A sheathed cable according to claim 6, in which one-piece crimpable insertion sleeve formed integrally on the sensor casing, which surrounds the cable insertion opening, and engages over the sensor end of the sheathed cable.

9. A sheathed cable according to claim 6, in which the connecting element is fastened to the sensor casing by a screwable fixing ring.

10. A sheathed cable according to claim 6, in which the sensor device comprises a pressure sensor and the receiving connection is a hydraulic connection.

11. A sheathed cable according to claim 6, in which the sheathed cable is secured in tension-resistant manner to the sensor casing by a crimp barrel.

12. A sheathed cable according to claim 11, in which the sensor casing, at or in the neighborhood of the sensor casing portion comprising the cable insertion opening, has a collar with a web which engages under the crimp barrel.

* * * * *